United States Patent [19]

Burrill, Jr. et al.

[11] 4,456,068

[45] Jun. 26, 1984

[54] PROCESS AND APPARATUS FOR THERMAL ENHANCEMENT

[75] Inventors: Charles E. Burrill, Jr., Billerica; Martin E. Smirlock, Brimfield; Ira P. Krepchin, Newton Upper Falls, all of Mass.

[73] Assignee: Foster-Miller Associates, Inc., Waltham, Mass.

[21] Appl. No.: 296,321

[22] Filed: Aug. 28, 1981

Related U.S. Application Data

[63] Continuation-in-part of Ser. No. 194,820, Oct. 7, 1980, abandoned.

[51] Int. Cl.[3] ..... E21B 43/24; E21B 36/02

[52] U.S. Cl. ..... 166/303; 60/39.59; 166/59; 166/266; 166/272

[58] Field of Search ..... 166/59, 63, 272, 302, 166/303; 60/39.55, 39.59, 39.82 H, 748

[56] References Cited

U.S. PATENT DOCUMENTS

| | | | |
|---|---|---|---|
| 2,584,606 | 2/1952 | Merriam et al. | 166/272 |
| 2,636,345 | 4/1953 | Zoller | 60/39.55 |
| 2,712,351 | 7/1955 | Roth et al. | 158/27.4 |
| 2,734,578 | 2/1956 | Walter | 166/11 |
| 2,770,097 | 11/1956 | Walker | 60/39.55 |
| 2,897,649 | 8/1959 | Reddy | 60/39.82 H |
| 3,254,721 | 6/1966 | Smith | 166/59 |
| 3,410,347 | 11/1968 | Triplett et al. | 166/59 |
| 3,456,721 | 7/1969 | Smith | 166/59 |
| 3,595,316 | 7/1971 | Myrick | 166/303 |
| 3,616,857 | 11/1971 | Pitkethly | 166/299 |
| 3,982,592 | 9/1976 | Hamrick et al. | 166/302 |
| 4,007,001 | 2/1977 | Schirmer et al. | 60/748 X |
| 4,077,469 | 3/1978 | Hamrick | 166/59 |
| 4,078,613 | 3/1978 | Hamrick et al. | 166/302 |
| 4,079,784 | 3/1978 | Howard et al. | 166/251 |
| 4,224,991 | 9/1980 | Sowa et al. | 166/272 |
| 4,301,657 | 11/1981 | Penny | 60/748 |
| 4,343,148 | 8/1982 | Shekleton | 60/748 X |
| 4,380,267 | 4/1983 | Fox | 166/303 |

*Primary Examiner*—George A. Suchfield

[57] ABSTRACT

Thermal treatment apparatus for downhole deployment comprising a combustion stage with an elongated hot wall combustion zone for the substantially complete combustion of the fuel-air mixture and an ignition zone immediately upstream from the combustion zone in which a mixture of atomized liquid fuel and air at or below stoichiometric ratio is ignited; together with a water injection stage immediately downstream from the combustion zone through which essentially partuculate free high temperature combustion products flow from the combustion zone and into which water is sprayed. The resulting mixture of steam and combustion products is injected into an oil formation for enhancing the speed and effectiveness of reservoir response due to physical, chemical, and/or thermal stimulation interactions.

11 Claims, 15 Drawing Figures

FIG 1
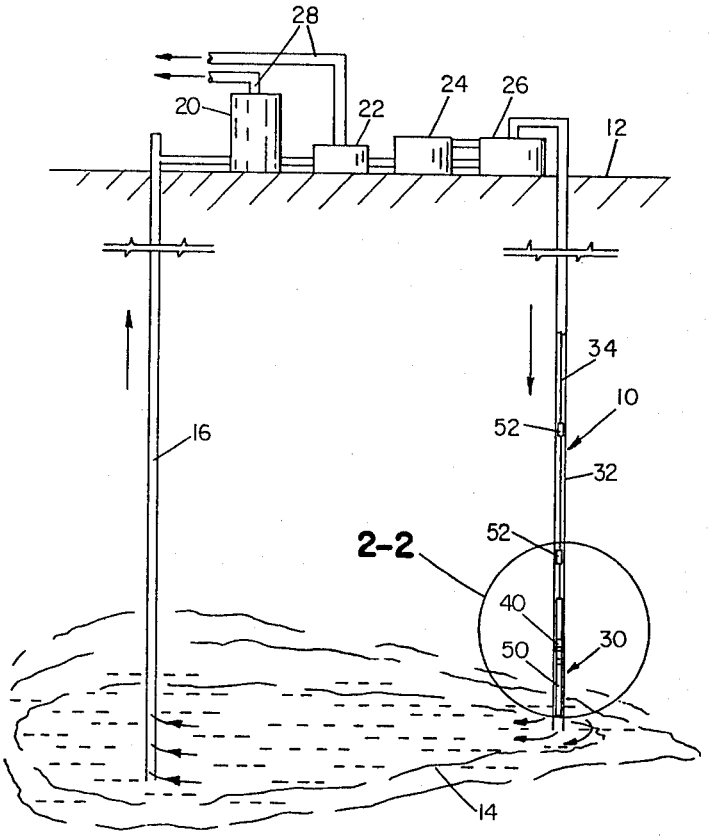
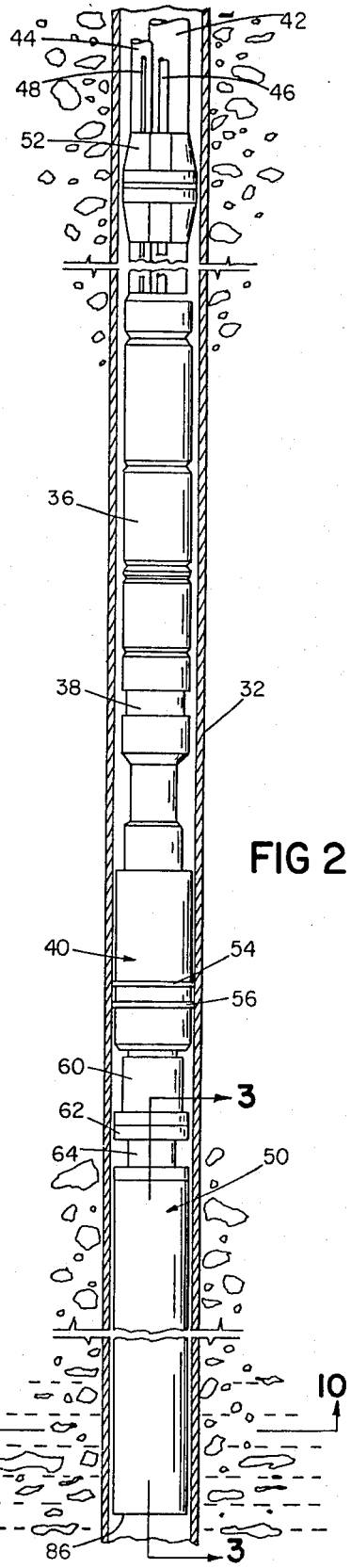
FIG 2
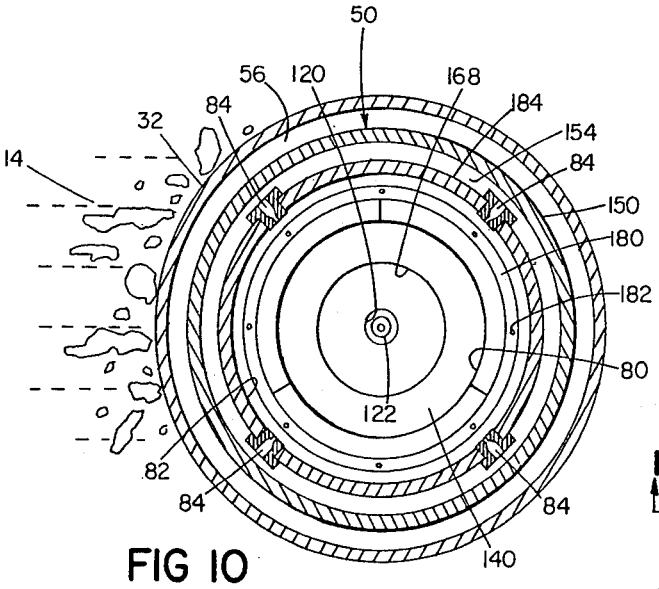
FIG 10

FIG 11
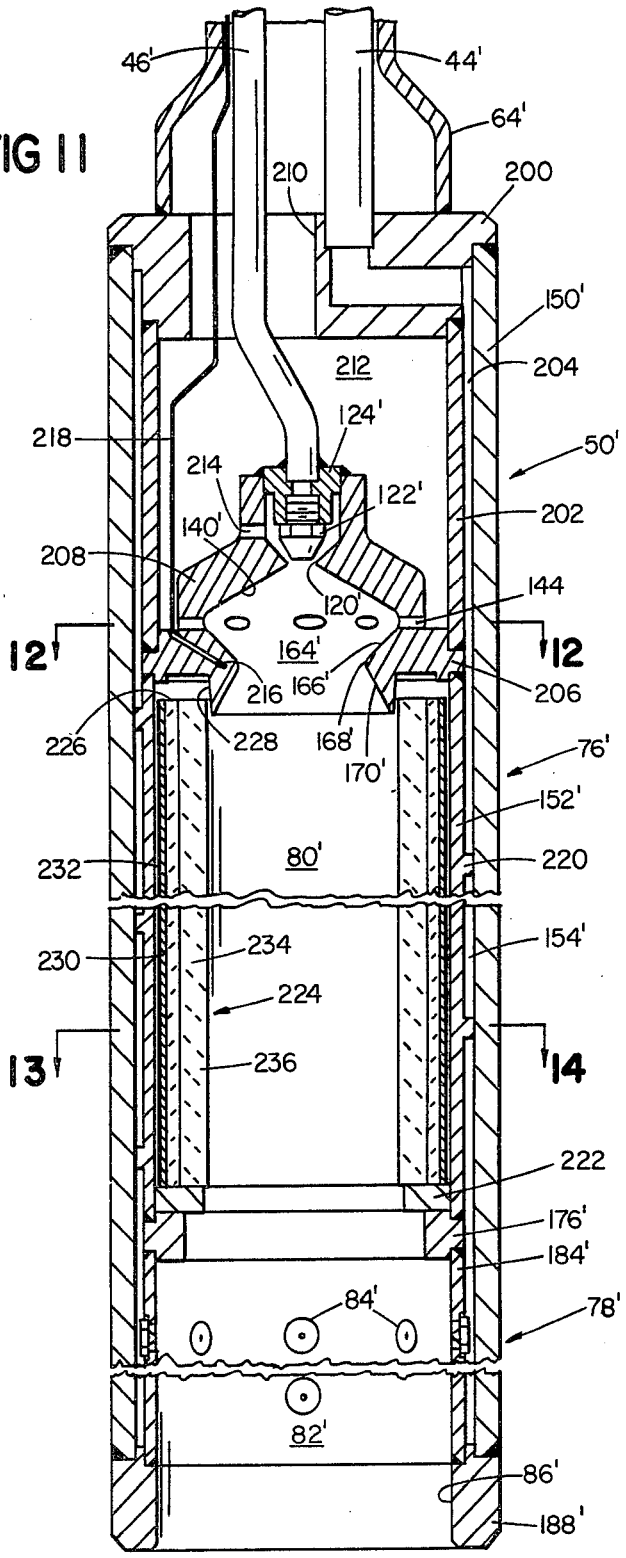
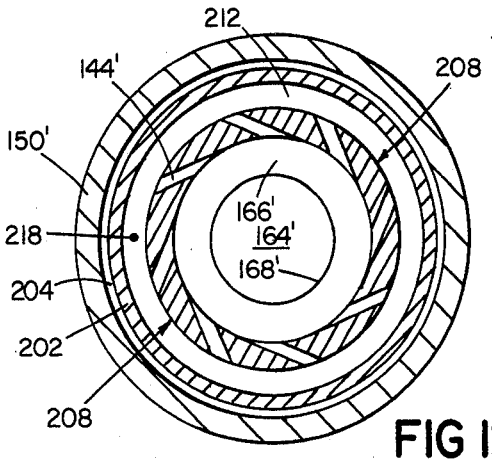
FIG 12
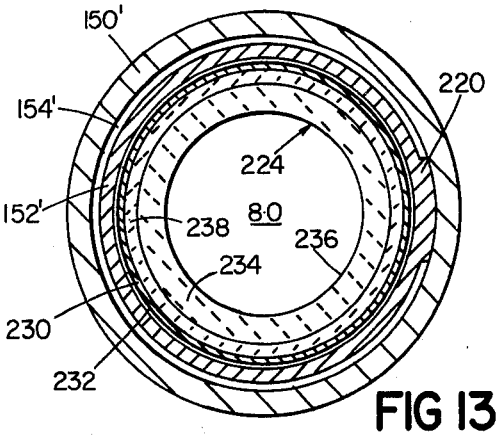
FIG 13
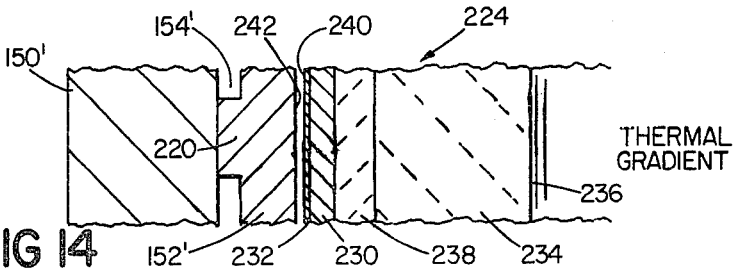
FIG 14
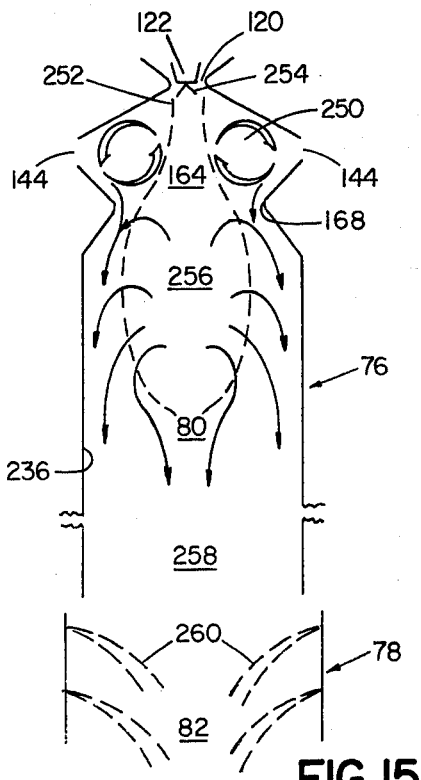
THERMAL GRADIENT
FIG 15

PROCESS AND APPARATUS FOR THERMAL ENHANCEMENT

The Government has rights in this invention pursuant to Contract No. Sandia 13-0246A awarded by the U.S. Department of Energy.

This application is a continuation-in-part of U.S. Ser. No. 194,820 filed Oct. 7, 1980 (now abandoned).

This invention relates to processes and apparatus for thermal treatment of subterranean geologic formations for enhancing recovery of geologic resources.

Thermal treatment of subterranean geologic formations is frequently useful in enhancing the recovery of geologic resources. For example, some petroleum materials, the so-called "heavy crudes," have viscosity and gravity characteristics such that those materials do not flow readily through the porous earth formations, and hence their recovery is exceedingly difficult. Recovery of such petroleum materials may be enhanced by flowing heated materials into the subterranean reservoir for viscosity reduction, mobility enhancement, and like purposes. In other recovery systems, thermal treatment apparatus may be used to promote chemical reactions, to initiate in situ combustion or retorting and the like. While thermal treatment systems have been proposed for downhole use, their operation has not been entirely satisfactory, due in part to the nature of the remote, relatively inaccessible and frequently harsh environment. Simple and sturdy constructions as well as simple and reliable controls are desirable for effective operation. It is also frequently desirable that the system not introduce either particulate material or excess oxygen into the geologic formation being treated.

In accordance with an aspect of the invention, there is provided thermal treatment apparatus for downhole deployment that includes a combustion stage with structure for intensely hot wall operation that defines a fuel-oxidant mixture combustion and retention zone, and ignition zone structure immediately upstream from the combustion zone in which a mixture of atomized liquid fuel and oxidant is ignited; together with a liquid injection stage immediately downstream from the combustion zone through which the stream of essentially particulate free, high temperature combustion products flows from the combustion zone and into which liquid to be vaporized is sprayed. The length of the chamber structure defining the hot wall combustion zone is preferably at least five times its width dimension and the zone is defined by a refractory wall whose surface is maintained at elevated temperature in excess of 2000° F. in an arrangement in which the burning fuel-oxidant mixture is retained within the combustion zone until combustion is completed so that an essentially particulate free stream of combustion products is discharged from the combustion zone into the geologic formation to be treated. The liquid injection stage preferably has an elongated chamber of dimensions similar to and axially aligned with the hot wall combustion zone chamber.

A thermal enhancement process in accordance with the invention for recovering hydrocarbon materials and the like from subterranean geologic formations includes the steps of positioning combustion chamber structure downhole adjacent the geologic formation to be treated, flowing an oxidant liquid fuel mixture at or below stoichiometric ratio into an ignition zone of the combustion chamber structure and igniting the mixture, flowing the burning mixture into a combustion zone defined by wall structure surface maintained at a temperature in excess of 2000° F., retaining the burning oxidant-fuel mixture in the combustion zone sufficiently long to insure substantially complete combustion, and then discharging the resulting essentially particulate free, oxygen free product mixture into the subterranean formation to be treated. The invention provides reduced risk of plugging and/or degrading the natural porosity of the formation into which the mixture is discharged. In a preferred embodiment, the resulting stream of essentially particulate free combustion products is flowed through a vaporization zone while injecting water into the flowing combustion products stream, and a mixture of steam and combustion products including carbon dioxide is injected into an oil bearing formation for producing chemical and thermal stimulation interactions to enhance the speed and effectiveness of reservoir response.

In a particular embodiment, the thermal treatment apparatus includes an elongated cylindrical body about six inches in outer diameter which is disposed downhole in a conventional oil well casing. A high temperature seal module is provided for deployment immediately above or below the thermal treatment apparatus for sealing the casing above the geologic formation to be treated. That high temperature seal module includes annular die structure and metal sealing rings which are hydraulically extruded through the dies into the annulus between packer and the well casing. Other types of high temperature packers can also be used. The combustion and liquid injection stages are housed in axial alignment within a common elongated sleeve that fits within the well casing with an annular cooling jacket chamber that extends the length of both the combustion and liquid injection stages through which the liquid to be vaporized is flowed. The combustion stage includes structure that defines a fuel injection zone with an atomizing nozzle that introduces a well atomized spray of fuel into the ignition zone in a coaxial sheath of air, and a refractory lined combustion chamber whose surface is maintained at an intensely hot temperature. Air flowed into the ignition zone through swirl passage structure establishes a forced vortex flow which maximizes aerodynamic shear and fuel-air mixing rates in a highly stirred zone with moderate temperature rise that provides stable ignition and enhanced fuel evaporation in the toroidal vortex. The downstream boundary of the forced vortex ignition zone is defined by fixed flame stabilizer structure that includes convergent-divergent throat structure with an extensively and highly stirred reverse flow zone immediately downstream from the throat structure that maximizes the combustion rate in the upstream end of the hot wall combustion zone. Downstream from the reverse flow zone and continuing through the hot wall combustion zone is a region of free vortex plug flow in which combustion is completed. The system provides flame stabilization in two separate but interconnected regions, a first region serving as an ignition zone and the second region providing a hot gas recirculation pattern that provides flame stability in a zone of high swirl and intensely back mixed flow which promotes efficient combustion. The hot refractory wall surface maximizes combustion of any remaining unburned materials and the thermal lag of that surface provides a ready ignition source for relight and helps smooth out variations in heat release rate due to process fluctuations.

The downstream elongated liquid injection stage includes a tubular sleeve that supports an array of axially and circumferentially spaced spray nozzles through which water is injected at a controlled rate to generate steam and/or to control the temperature of the discharged mixture of combustion products and vaporized liquid.

Liquid fuels are efficiently burned in downhole environments with processes and apparatus in accordance with the invention with complete combustion so that the resulting stream of combustion products is essentially particulate free. The system is simple and sturdy in construction, is efficient and provides reliable operation over a range of operating conditions.

Other features and advantages of the invention will be seen as the following description of a particular embodiment progresses, in conjunction with the drawings, in which:

FIG. 1 is a diagram of a thermal recovery system in accordance with the invention;

FIG. 2 is an enlarged view of a portion of the injection well of FIG. 1;

FIG. 10 is a sectional view taken along the line 10—10 of FIG. 2;

FIG. 11 is a sectional view of portions of another thermal stimulation unit in accordance with the invention;

Figure 4:
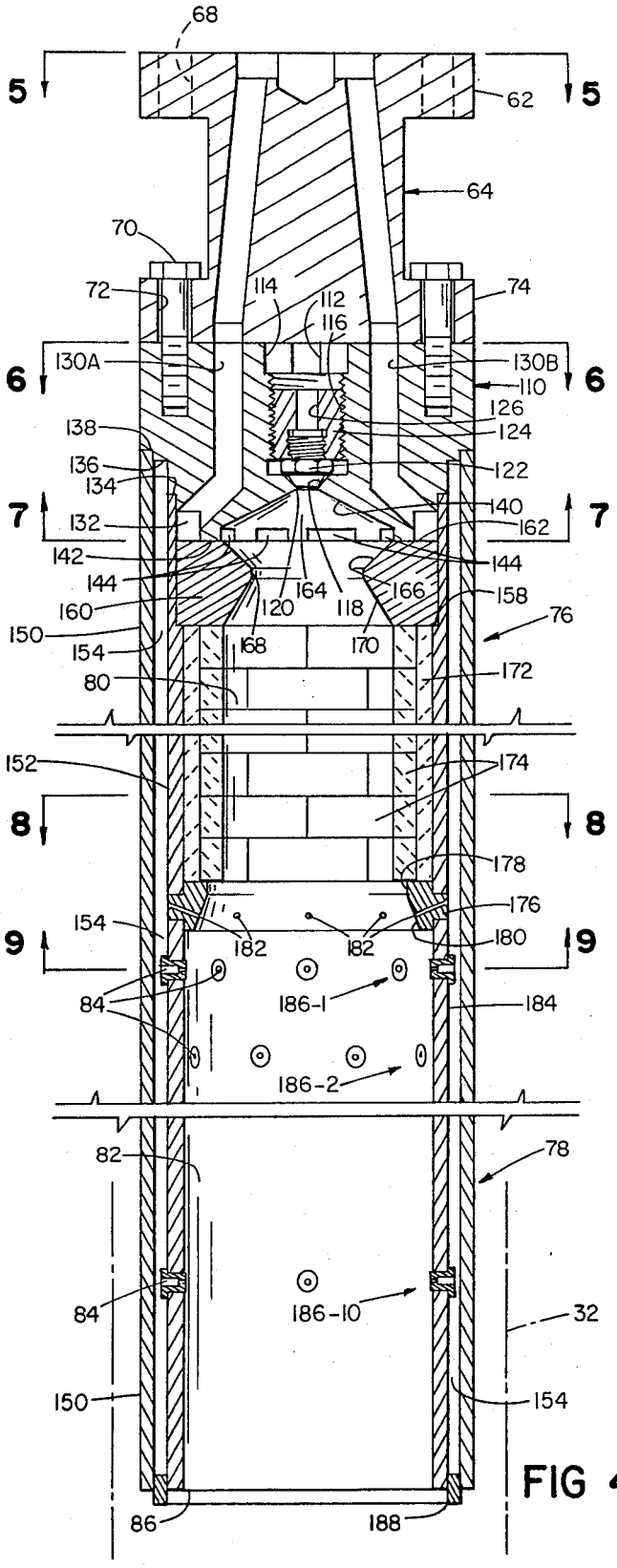
FIG. 4 is a sectional view, on an enlarged scale, of portions of the thermal stimulation unit taken along the line 4—4 of FIG. 3.

FIGS. 12 and 13 are sectional views taken along the lines 12—12 and 13—13 respectively of FIG. 11;

FIG. 14 is an enlarged sectional view of a portion of the unit shown in FIG. 11; and FIG. 15 is a diagram indicating aerodynamic flow conditions in the thermal stimulation units shown in FIGS. 4 and 11.

DESCRIPTION OF PARTICULAR EMBODIMENTS

The system shown in FIG. 1 includes an injection well 10 that extends downwardly from the surface 12 of the ground to an oil reservoir 14 or other similar subsurface geologic formation. A producing well 16 extends upwardly from reservoir 14 to processing equipment that includes such apparatus as oil/water separation unit 20, and flotation separation unit 22. Steam generator support equipment includes air compressor 24 and fuel tank 26. Supplies including liquid fuel (such as No. 2 fuel oil, No. 6 fuel oil, or preprocessed crude oil), air, and water are fed from the surface equipment through injection well 10 to thermal stimulation system 30 at the base of well 10. Steam and $CO_2$ are produced by system 30, released into reservoir 14, and stimulate flow of hydrocarbon materials from reservoir 14 through producing well 16 to surface treatment equipment 20, 22 for pumping to a refinery over lines 28.

Further details of the downhole thermal stimulation system 30 may be seen with reference to FIG. 2. That stimulation system is supported within a seven inch diameter steel casing 32 by a tubing string 34 and includes a conventional packer body 36, a conventional slip assembly 38, a high temperature sealing module 40 and a steam generation unit 50. The tubing string 34 includes jointed pipe sections 42 (air supply) and 44 (water supply); a small diameter continuous tubing fuel line 46, and a small diameter continuous tubing hydraulic fluid line 48 for the packer. Tubing lines 46 and 48 are strung along side the jointed pipe sections 42, 44 and restrained at regular intervals by tube clamps 52 that both support the continuous tubing lines 46, 48 and center the bundle within the casing 32. Slip assembly 38 and seal module 40 are hydraulically set. The high temperature seal module 40 includes a pair of dies through which metal sealing rings 54, 56 are hydraulically extruded into the annulus between packer 40 and the well casing 32. To set seal module 40, hydraulic fluid from the surface (at 15,000 psi) first causes the slips to deploy and then extrudes the sealing rings 54, 56. Further details of seal module 40 may be had with reference to copending application Ser. No. 125,981 filed Feb. 29, 1980, entitled PACKER and assigned to the same assignee as this application, which disclosure is incorporated herein by reference. The assembly is retrieved in conventional manner by pulling upward on the tubing string 34, thus causing the slips to release and the sealing rings to loosen.

Figure 3:
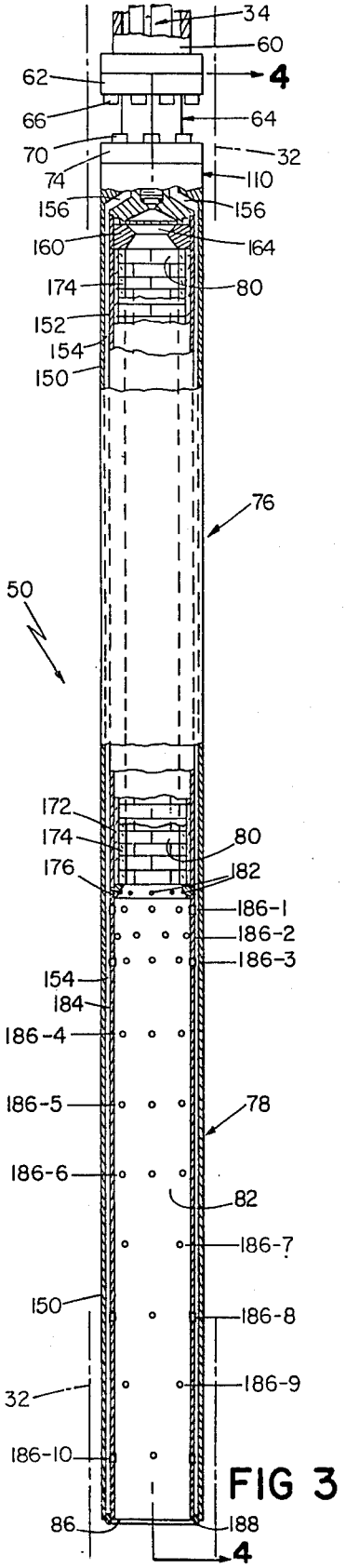
FIG. 3 is a sectional view of the thermal stimulation unit taken along the line 3—3 of FIG. 2.

Further details of the steam generator unit 50 may be had with reference to FIGS. 3 and 4. That generator unit is secured to flanged nipple 60 which is attached to the lower end of packet module 40. The upper flange 62 of coupling 64 is secured to nipple 60 by bolts 66 which pass through bolt holes 68. In similar manner bolts 70 pass through bolt holes 72 in the lower flange 74 of adaptor 64 to secure the upper end of the steam generator unit 50 against flange 74.

That steam generator unit includes axially aligned combustion section 76 and vaporizer section 78. Combustor section 76 includes a tubular refractory lined combustion chamber 80 that has a length of about thirty-six inches and an internal diameter of about three inches. Vaporizer section 78 has an axially aligned tubular chamber 82 that is about thirty-six inches in length and has an inner diameter of about 4½ inches. A series of circumferentially extending arrays of jet nozzles 84 extends axially along the length of vaporizer chamber 82, the number of nozzles 84 in each circumferential array being greatest at the inlet end of vaporizer chamber 82 and decreasing towards outlet port 86.

Figure 5:
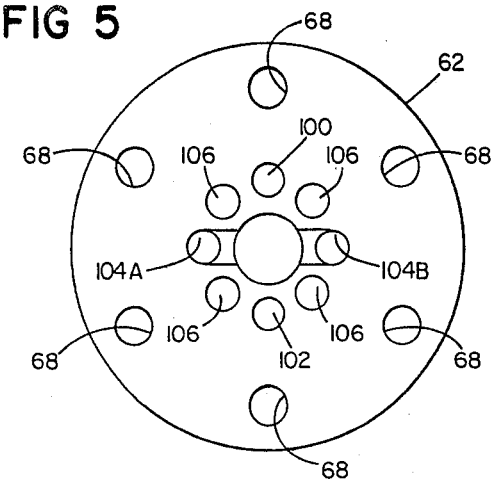
FIGS. 5-9 are sectional views taken along the lines 5—5, 6—6, 7—7, 8—8, and 9—9 respectively of FIG. 4.
Figure 6:
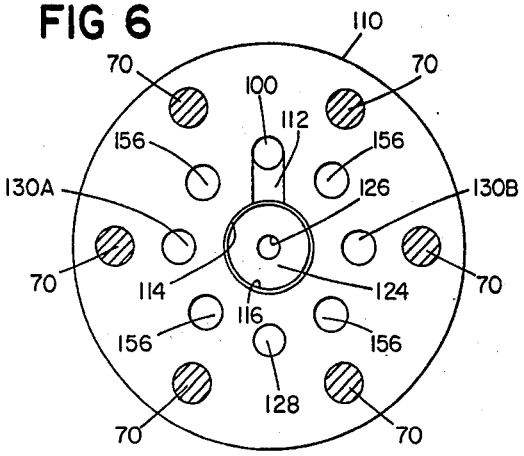

As indicated in FIGS. 4 and 5, a number of passages extend through adaptor coupling 64, including fuel passage 100, electronics passage 102, two air passages 104A and 104B, and four water passages 106. Coupling 64 is bolted to nozzle housing 110, as indicated in FIGS. 4 and 6, so that fuel passage 100 communicates with inclined groove 112 that extends to central chamber 114 in nozzle housing 110. Chamber 114 has an internal threaded bore 116 and an outlet port 120 which is surrounded by conical surface 118 on which atomizing nozzle unit 122 is seated. Nozzle unit 122 may be of the hollow cone type with a nominal spray angle of 75 degrees (measured at 40 psi), an orifice diameter of 0.063 inch and a core that imparts swirling motion to the liquid fuel. Nozzle 122 is threaded into adaptor 124 which has a central through passage 126 and which in turn is threaded into the bore of central chamber 114, so that the conical outer surface of the nozzle 122 is firmly seated at port 120.

Figure 7:
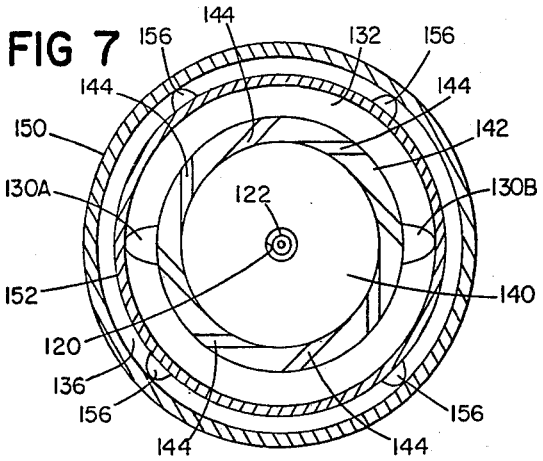

As shown in FIGS. 4 and 6, air passages 130A, 130B (which are aligned with corresponding passages 104A, 104B in adaptor 64) extend through nozzle housing 110 on either side of central chamber 114. The lower ends of passages 130 terminate at an annular recess 132 (FIGS. 4 and 7) at the lower periphery of housing 110. Formed in the cylindrical wall of housing 110 above recess 132 are a stepped series of annular surfaces 134, 136, 138; and formed in the lower surface of nozzle housing 110 is a conical surface 140 that extends outwardly from port 120 to an annular ridge 142 in which are formed an array of eight slots 144.

Seated on surface 138 is the upper end of outer sleeve 150 (a stainless steel tube of ⅜ inch wall thickness, 79 inches in length, and six inches in diameter); and seated on surface 134 is an inner combustor housing sleeve 152 (a stainless steel tube of ¼ inch wall thickness, 38 inches in length, and five inches in diameter) such that an elongated annular passage 154 defined between sleeves 150 and 152. Four water supply passages 156 (FIG. 6) in nozzle housing 110 extend from passage 106 in adaptor 64 to the upper end of annular passage 154 at points immediately below surface 136.

The upper end of sleeve 152 has a counterbore 158 in which flame stabilizer throat member 160 is received. The planar upper surface 162 of throat 160 is seated on the planar end surface of ridge 142 and forms the lower boundary of air supply plenum 132. Air supplied through passages 104A, 104B and 130A, 130B to annular plenum 132 flows inwardly through swirl channels 144 into an ignition zone 164 bounded on its upper side by conical nozzle holder surface 140 and on its lower side by conical surface 166 of flame stabilizer member 160. Convergent surface 166 of throat member 160 extends to two inch diameter throat orifice 168 and divergent surface 170 defines an expansion transition to lined combustion chamber 80. Flame and temperature sensors monitor ignition zone 164 and transmit signals over conductors that extend through passages 128 and 102.

Figure 8:
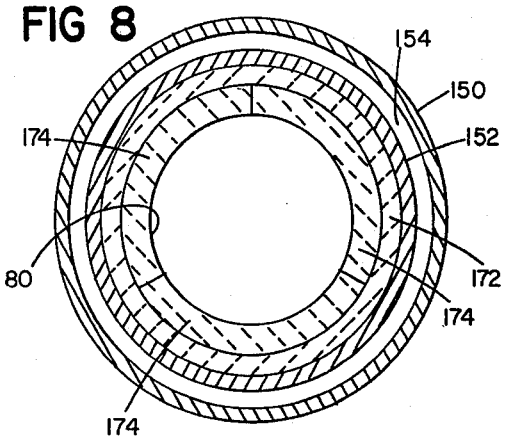

Received within combustor housing sleeve 152 and seated on the lower surface of throat member 160 is a cast aluminum oxide ($Al_2O_3$) refractory sleeve 172 of ⅜ inch thickness, and an array of arcuate aluminum oxide ($Al_2O_3$) refractory segments 174, each ⅜ inch in thickness and 120 degrees in angular extent. The inner surfaces of arcuate segments 174 define the inner wall of combustion chamber 80 as indicated in FIG. 8. Sleeve 172 and the array of arcuate segments 174 are secured within sleeve 152 by a transition ring 176 that is welded to the lower end of sleeve 152. Transition ring 176 has a cylindrical surface 178 of four inch diameter and a lower surface 180 that diverges at an angle of 35 degrees to the system axis. Extending through ring 176 from chamber 154 to surface 180 are an array of eight jet spray passages 182, each 0.030 inch in diameter.

Figure 9:
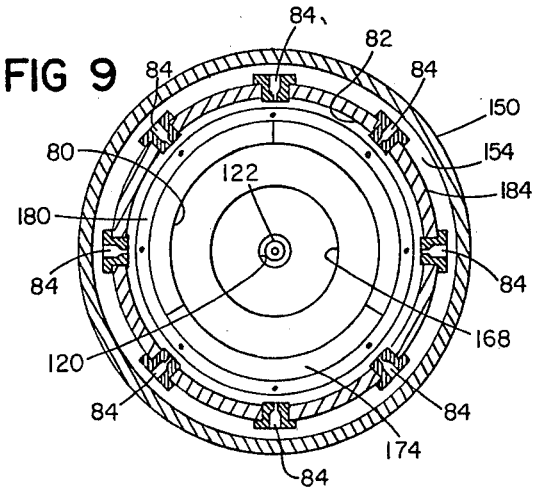

Welded in similar manner to the lower end of transition ring 176 is vaporizer chamber sleeve 184 (a stainless steel tube of ¼ inch wall thickness, 38 inches in length, and five inches in diameter) which defines vaporization zone 82. A series of ten circumferential arrays 186 of jet nozzles 84 are secured in bores through the wall of sleeve 184, there being three circumferential arrays (186-1-3) of eight nozzles each (axially spaced about two inches apart) (FIG. 9), three circumferential arrays (186-4-6) of six nozzles each (axially spaced about two inches apart), and four circumferential arrays (186-7-10) of four nozzles each, (axially spaced about four inches apart) along the axial length of vaporization zone 82. Each jet nozzle 84 is of the hollow cone type and has an 0.030 inch diameter orifice. Spacer ring 188 is welded to the end surfaces of sleeves 150 and 184 and defines the lower end of annular water supply chamber 154. A cross-sectional view of vaporizer zone 82 is shown in FIG. 10.

Details of another thermal enhancement unit 50' may be had with reference to FIGS. 11–14, in which elements corresponding to those of generator unit 50 are identified with a primed reference numeral. Unit 50' has tubular coupling adaptor 64' welded to end plate 200. The upper ends of outer sleeve 150' (a stainless steel tube of about ½ inch wall thickness, six inches in outer diameter, and 79 inches in length) and inner transition sleeve 202 (a stainless steel tube of about ¼ inch wall thickness and about five inches in outer diameter) are also welded to end plate 200 so that an annular passage 204 is defined between those sleeves into which water is introduced from conduit 44'.

Welded to the lower end of transition sleeve 202 is flange 206 of ignition zone member 208. Carried by member 208 is adaptor 124' to which nozzle 122' is threadedly received and to which fuel oil is supplied through conduit 46'. Air flow through coupling adaptor 64' and port 210 in end plate 200 flows into the chamber 212. A portion of that air flows through passage 214 into the nozzle region for exit through orifice 120' in a coaxial sheath that surrounds the spray of atomized fuel droplets from nozzle 122' into the ignition zone 164'. Air also flows from chamber 212 through swirl passages 144' into the periphery of ignition zone 164'. Ignition zone member has a convergent surface 166' to a two inch diameter throat orifice 168' and a lower divergent surface 170'. Signals from temperature sensor 216 are transmitted over conductor 218 to surface located monitoring equipment. Welded to the lower side of flange 206 is the upper end of sleeve 152' (a stainless steel tube of about ¼ inch wall thickness, 38 inches in length, and five inches in outer diameter) such that an elongated passage 154' is defined between sleeves 150' and 152'. Ridge 220 helically extends (with a pitch of five inches) about inner sleeve 202 and outer sleeve 150' is shrunk or press fitted on sleeve 152' such that water flow is directed along a helical path through passage 154'.

Welded to the lower end of sleeve 152' is transition ring 176' and seated on transition ring 176' is support ring 222. Housed within sleeve 152' and supported on support ring 222 is a refractory wall assembly 224 whose upper end 226 extends into the recess defined by outer surface 228 of ignition zone member 208. Assembly 224 includes stainless steel metal sleeve 230 (a tube of about ⅛ inch wall thickness and an outer diameter of about 4 5/16 inches) with a sprayed zirconia coating 232 on its outer surface; an inner sleeve 234 of cast high purity silicon carbide that has an inner surface 236 of three inches diameter and a one-half inch wall thickness; and an intermediate region 238 (about ⅛ inch in thickness) filled with cast aluminum oxide cement. The intermediate filled region 238 is cast in situ and cured at about 1000° F. for several hours. At ambient temperature, there is a gap of about 0.01 inch between the outer surface 240 of sleeve coating 232 and the inner surface 242 of sleeve 152' as indicated in FIG. 14.

Welded to the lower surface of transition ring 176' is sleeve 184' (a length of about 33 inches) that carries an array of spray nozzles 84'. Spacer ring 188' is welded to the lower ends of sleeves 150' and 184' and defines the lower end of annular water chamber 154', as well as outlet port 86'.

In use, steam generation system 30 is secured to tubing string 34 and lowered into the bore hole casing 32.

After the steam generation system 30 is positioned in the bore hole adjacent the subterranean formation to be treated, as indicated in FIGS. 1 and 2, packer slips 38 and seal 40 are hydraulically set, as indicated above, to provide a sealed pressure zone in communication with reservoir 14 in which system 30 is disposed. Liquid fuel is then flowed through line 46 (46') to nozzle 122 (122') for atomization and spraying into ignition zone 164 (164') as indicated in FIG. 15. Simultaneously air is supplied in stoichiometric ratio through passages 104 and 130 (port 210) to annular plenum 132 (chamber 212) and flows through swirl passages 144 (144') into ignition zone 164 (164') to form a forced vortex flow 250, and through port 214 into nozzle chamber for flow through orifice 120 (120') in a sheath 252 about the jet 254 of atomized fuel droplets from nozzle 122 (122'). Fuel ignition is by means of a hypergolic liquid (for example, triethylborane) flowed through fuel line 46 (46') in advance of the liquid fuel. The hypergolic liquid ignites in ignition zone 164 (164') in the presence of the sheath and swirl air flows and ignites the fuel-air mixture.

As the ignited fuel-air mixture burns, it flows through throat 168 (168') into highly stirred reverse flow zone 256 (at the upper end of refractory liner sleeve 172 (232)) which maximizes the combustion rate at the upper end of combustion zone 80 and then flows downstream from reverse flow zone 256 through zone 258 of free vortex plug flow in which combustion is completed. The refractory-lined wall surface 236 of the elongated combustion chamber provides a stable, high temperature (its temperature being in the order of 2600° F.), long residence time flow environment in which combustion of the liquid fuel is completed so that the stream of high temperature (about 3500° F.) combustion product gases that are discharged through transition ring 176 (176') into vaporization zone 82 is essentially free of particulates.

In operation of the burner system shown in FIGS. 11–13, the liner assembly 224 expands and water jacket sleeve 152' limits that expansion so that refractory sleeve 234 is maintained under compression. The intermediate refractory material 238 provides a transition region between the high temperature refractory sleeve 234 and the cooler metal sleeve 230 whose temperature during operation is controlled by contact with water jacket sleeve 152', a thermal gradient as diagrammatically indicated in FIG. 14 being established across the liner components.

Water to be vaporized flows along the length of combustion zone 80 (limiting the temperature rise of the refractory liner) to the vaporization zone 82. Jets 260 of water spray through nozzles 182 and 84 (84') into the flow of combustion products in the vaporization zone and flash to steam, with the resulting mixture of steam and combustion products being discharged through outlet port 86 (86') for flow into oil reservoir 14.

A range of characteristics of this steam generator system are set out in the following table:

| | Injection Pressure | | |
|---|---|---|---|
| | 1000 psi | 2000 psi | 3000 psi |
| Maximum Firing Rate, BTU/hr | $10 \times 10^6$ | $20 \times 10^6$ | $20 \times 10^6$ |
| Steam output, lbs/hr | 8874 | 17,748 | 17,748 |
| Required Air Flow, lb/hr | 7569 | 15,138 | 15,138 |
| Required Water Flow, lb/hr | 8107 | 16,214 | 16,214 |
| Required Fuel Flow, lb/hr | 506 | 1,012 | 1,012 |

-continued

| | Injection Pressure | | |
|---|---|---|---|
| | 1000 psi | 2000 psi | 3000 psi |
| (Steam Generator) | | | |

The system delivers 80 percent quality steam at reservoir pressures of up to 3000 pounds per square inch in quantities of up to 1400 barrels per day.

In one test run of the system shown in FIGS. 11–13 of 80 hours duration at firing rates from 1–5 million BTU per hour, using a Delavan Type A hollow cone pressure atomizing 80 degree 12 gallon per hour nozzle, No. 2 fuel oil and air at stoichiometric ratio were flowed through the system with steam generation at pressures of 100–500 psig. In another test run at atmospheric pressure with emulsified No. 6 fuel oil using a Delavan Type SNA air atomizing nozzle and stoichiometric air-fuel ratios the system operated at firing rates of 128–180,000 BTU per hour. In each run the output stream from the system contained less than ½ percent oxygen and was essentially particulate free (on the average, the output streams contained less than five parts per million particles greater than two microns in size).

Improved downhole thermal treatment processes and apparatus of the invention are capable of prolonged operation over a wide range of firing rates and reservoir pressures; the apparatus is of compact construction and suitable for use in connection with conventional oil field equipment; and the invention offers significant time and cost savings over surface generated steam for heavy oil recovery from deep reservoirs as well as other processes for recovery of resources from subterranean geologic formations.

While particular embodiments of the invention have been shown and described, various modifications will be apparent to those skilled in the art, and therefore it is not intended that the invention be limited to the disclosed embodiment or to details thereof, and departures may be made therefrom within the spirit and scope of the invention.

What is claimed is:

1. Thermal treatment apparatus for downhole deployment in the casing of a well for supplying an essentially particulate free mixture of gases at a high injection pressure to a downhole geologic formation comprising combustion stage structure having ignition zone structure in which a mixture of liquid fuel and an oxidant are ignited and downstream combustion zone chamber structure that defines an elongated hot wall combustion zone of uniform cross-sectional configuration of length sufficient for the substantially complete combustion of the fuel-oxidant mixture;

elongated tubular liquid injection stage chamber structure downstream from said combustion stage chamber structure through which high temperature combustion products flow from said combustion stage chamber structure, the passage between said combustion chamber stage structure and said liquid injection stage chamber structure having a cross-sectional area at least as large as the cross-sectional area of said combustion zone, and an array of spray nozzles in the wall of said injection stage chamber structure for spraying liquid into said injection stage chamber for interaction with the stream of combustion products from said combustion zone chamber and vaporization such that an essentially particulate-free mixture of combustion products and vaporized liquid is discharged at high pressure from said injection stage chamber structure for flow into the subterranean formation to be treated, and packer structure adjacent said combustion stage structure for sealingly engaging the casing wall of the well to provide a sealed pressure zone in which said apparatus is disposed, said packer structure having through passages for supplying fuel, oxidant, and liquid to components downstream from said packet structure.

2. The apparatus of claim 1 wherein said ignition zone structure includes an atomizing nozzle for spraying a cone of atomized liquid fuel into said ignition zone, and swirl passage structure for introducing a gaseous oxidant into said ignition zone for mixing with the fuel.

3. The apparatus of claim 1 and further including a common elongated sleeve in which said combustion zone and liquid injection stage chambers are housed in axial alignment with an annular passage extending the length of both of said chambers for supplying liquid to said spraying means, said sleeve having an outer diameter less than the inner diameter of the well casing of the well in which said apparatus is to be deployed.

4. Thermal treatment apparatus for supplying a gaseous mixture to a downhole geologic formation comprising combustion stage structure having ignition zone structure in which a mixture of liquid fuel and an oxidant are ignited and downstream combustion zone structure of length sufficient for the substantially complete combustion of the fuel-oxidant mixture;

said ignition zone structure including an atomizing nozzle for spraying a cone of atomized liquid fuel into said ignition zone, swirl passage structure for introducing a gaseous oxidant into said ignition zone for mixing with the fuel, and convergent-divergent flame stabilizer throat structure downstream from said atomizing nozzle, liquid injection stage structure downstream from said combustion stage structure through which high temperature combustion products flow from said combustion stage structure; and means for spraying a liquid to be vaporized into said injection stage structure such that combustion products and vaporized liquid is discharged for flow into the subterranean formation to be treated.

5. The apparatus of claim 4 wherein said combustion zone chamber includes a liner of refractory material, and an annular liquid flow passage surrounding said combustion chamber liner.

6. Thermal treatment apparatus for downhole deployment in the casing of a well for supplying a gaseous mixture to a downhole geologic formation comprising combustion stage structure having ignition zone structure in which a mixture of liquid fuel and an oxidant are ignited and downstream combustion zone structure of length sufficient for the substantially complete combustion of the fuel-oxidant mixture;

said ignition zone structure including an atomizing nozzle for spraying a cone of atomized liquid fuel into said ignition zone, swirl passage structure for introducing a gaseous oxidant into said ignition zone for mixing with the fuel; convergent-divergent flame stabilizer throat structure downstream from said atomizing nozzle;

liquid injection stage structure downstream from said combustion stage structure through which high temperature combustion products flow from said combustion stage structure; means for spraying a liquid to be vaporized into said injection stage structure such that combustion products and vaporized liquid is discharged into the subterranean formation to be treated; and packer structure upstream from said combustion stage structure for sealingly engaging the wall of the well casing in which said apparatus is disposed, said packer structure having through passages for supplying fuel, oxidant, and liquid to components downstream from said packer structure.

7. A process for thermal enhancement in a downhole environment for the recovery of oil and the like comprising the steps of providing combustion chamber structure that defines a combustion zone of length at least five times its cross-sectional width dimension;

igniting an oxidant liquid fuel mixture in said combustion chamber structure at a pressure of at least about 500 pounds per square inch, flowing the burning mixture through said elongated combustion zone to provide substantially complete combustion while maintaining the wall defining said combustion zone of said combustion chamber structure during said combustion process at a temperature in excess of 2000° F. to maximize combustion of the fuel-oxidant mixture and to provide a ready ignition source for relight;

then flowing the resulting essentially particulate-free stream of combustion products through a vaporization zone axially aligned with and downstream from said combustion zone while injecting liquid into the flowing combustion product stream to vaporize the liquid; and then discharging the resulting mixture of combustion products and vaporized liquid at a pressure of at least about 500 pounds per square inch into the subterranean formation to be treated.

8. A process for recovery of hydrocarbon materials and the like from subterranean geologic formations comprising the steps of positioning combustion chamber structure downhole adjacent the subterranean geologic formation to be treated, flowing oxidant and liquid fuel downhole to said combustion chamber structure to provide a fuel-oxidant mixture at or less than stoichiometric ratio, igniting said fuel-oxidant mixture in an ignition region in said downhole structure at a pressure of at least about 500 pounds per square inch, providing a forced vortex oxidant flow zone in said ignition region and a highly stirred reverse flow zone downstream from said forced vortex zone at the upper end of said combustion chamber for enhancing the combustion rate, flowing the burning oxidant-fuel mixture through said combustion chamber structure at a rate such that the burning mixture is retained in said chamber until combustion is substantially complete while maintaining the combustion zone defining wall of said combustion chamber structure during said combustion process at a temperature in excess of 2000° F. to maximize combustion of the fuel-oxidant mixture and to provide a ready ignition source for relight, then flowing the resulting essentially particulate-free, oxygen free stream of combustion products from said combustion chamber through a vaporization zone while injecting liquid into the flowing combustion products stream and discharging the resulting mixture of combustion products and vaporized liquid into the subterranean geologic formation to be treated.

9. The process of either claim 7 or 8 wherein said oxidant is air, said fuel is a liquid fuel oil and said liquid is water.

10. The process of claim 9 wherein said air-fuel mixture is burned in said combustion zone at a firing rate of at least about 2.5 million BTU per hour.

11. The process of claim 10 wherein said combustion zone has a length at least five times its cross-sectional width dimension, and said vaporization zone is axially aligned with said combustion zone.

* * * * *